United States Patent [19]

Hutchison

[11] 4,197,910

[45] Apr. 15, 1980

[54] JET DEVICE FOR USE IN WELLS

[75] Inventor: Stanley O. Hutchison, Bakersfield, Calif.

[73] Assignee: Chevron Research Company, San Francisco, Calif.

[21] Appl. No.: 892,442

[22] Filed: Mar. 31, 1978

[51] Int. Cl.[2] ..... B08B 3/00

[52] U.S. Cl. ..... 166/223; 134/167 C; 175/422

[58] Field of Search ..... 166/222, 223, 173; 175/422; 134/166 C, 167 C, 168 C, 169 C

[56] References Cited

U.S. PATENT DOCUMENTS

| | | | |
|---|---|---|---|
| 2,228,640 | 1/1941 | O'Neill | 166/223 |
| 2,302,567 | 11/1942 | O'Neill | 166/223 X |
| 2,526,695 | 10/1950 | Schulmberger | 166/223 X |
| 3,224,506 | 12/1965 | Huitt et al. | 166/223 X |
| 3,646,947 | 3/1972 | Rochelle et al. | 134/167 C |
| 4,073,302 | 2/1978 | Jones | 134/167 C |

*Primary Examiner*—William F. Pate, III

*Attorney, Agent, or Firm*—R. L. Freeland, Jr.; George W. Wasson

[57] ABSTRACT

Apparatus for jet-cleaning wells having different-diameter casing strings, which apparatus includes an elongated member for running into the well, and a movable member having a jet body for forming a jet connected to the elongated member, which movable member moves out against the casing string responsive to application of jetting liquid between the movable member and the elongated member.

7 Claims, 4 Drawing Figures

FIG_3
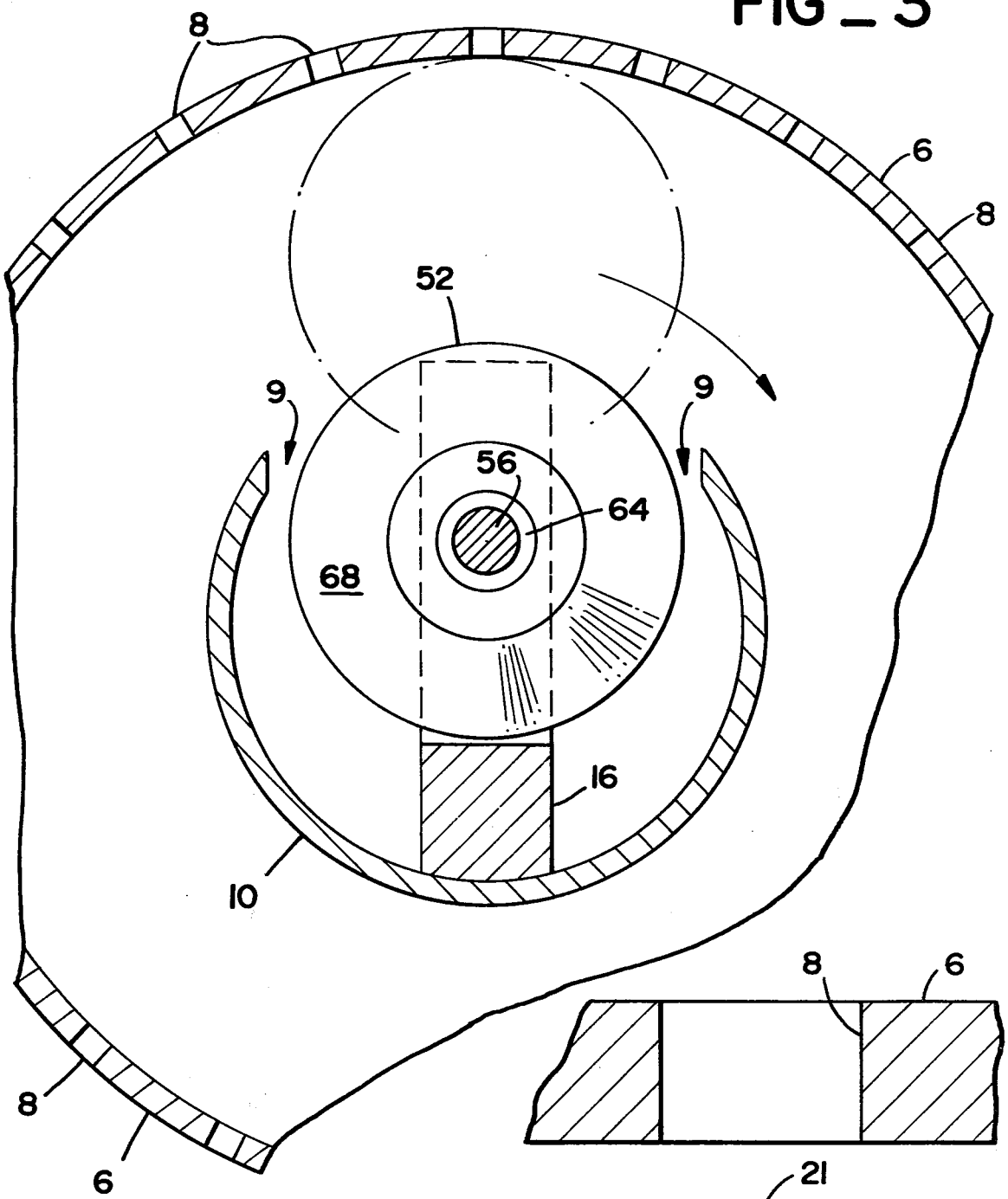
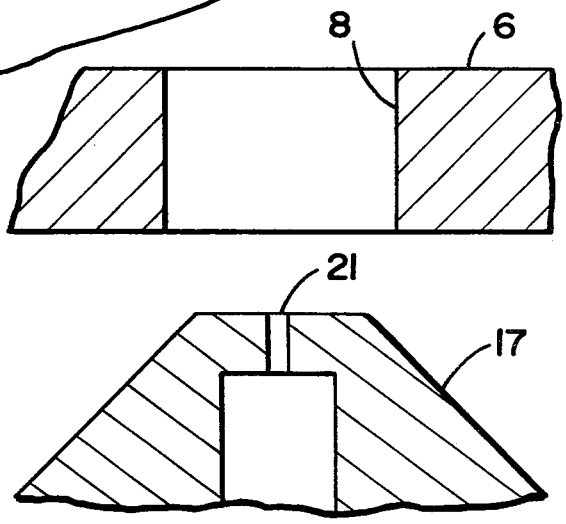
FIG_4

JET DEVICE FOR USE IN WELLS

FIELD OF THE INVENTION

The present invention relates to cleaning fluid flow openings in well casing and liners using jetted fluid and primarily jetted liquid. The apparatus of the present invention includes a movable member having a jet body connected thereto which, in response to liquid pressure, moves out against the well casing or liner to bring the jet to within a desired standoff distance from the openings in the casing or liner to provide effective cleaning.

BACKGROUND OF THE INVENTION

As set out in my U.S. Pat. No. 3,720,264, effective cleaning of openings in well liners can be done with liquid jets, provided that the jets have a velocity in excess of 700 feet per second and are directed at the liner from a standoff distance of less than 10 times the diameter of the jet orifice. Apparatus for accomplishing this effective cleaning method is described and claimed in U.S. Pat. No. 3,720,264 and divisionals thereof. Large-diameter casing in the 10- to 20-inch range, however, presents problems in easily obtaining the desired standoff distance with a single jet tool. This invention is directed to overcoming these problems.

BRIEF DESCRIPTION OF THE INVENTION

The present invention provides apparatus for use in cleaning openings in well conduits. An elongated member adapted to be run into a well to a location where cleaning is desired is provided with a stationary member connected thereto. A movable member is slidably connected to the stationary member for movement perpendicular to centerline of the elongated member toward a well conduit such as a well liner in response to liquid pressure applied between the movable member and the stationary member. A jet body having a central jet forming-opening for forming a jet of liquid is connected to the movable member. Passageway means are formed in the movable member to provide for liquid communication to the jet-forming opening and to a location between the movable member and the stationary member. A liquid inlet port providing liquid communication into the passageway means from outside the movable member and the stationary member serves as an entry for jetting liquid.

OBJECTS OF THE INVENTION

The principal object of the present invention is to provide apparatus for use in jet-cleaning openings in well liners, which apparatus includes a movable jet body which in response to liquid pressure moves out against the well liner to give a desired standoff distance for the jet from the liner. Further objects and advantages of the present invention will become apparent from the following detailed description read in view of the accompanying drawings, which are made part of this specification.

BRIEF DESCRIPTION OF THE DRAWINGS

FIG. 3 is a sectional view taken at 3—3 of FIG. 1; and

FIG. 4 is an enlarged fragmentary sectional view of a jet body and liner.

DETAILED DESCRIPTION OF THE INVENTION

Figure 1:
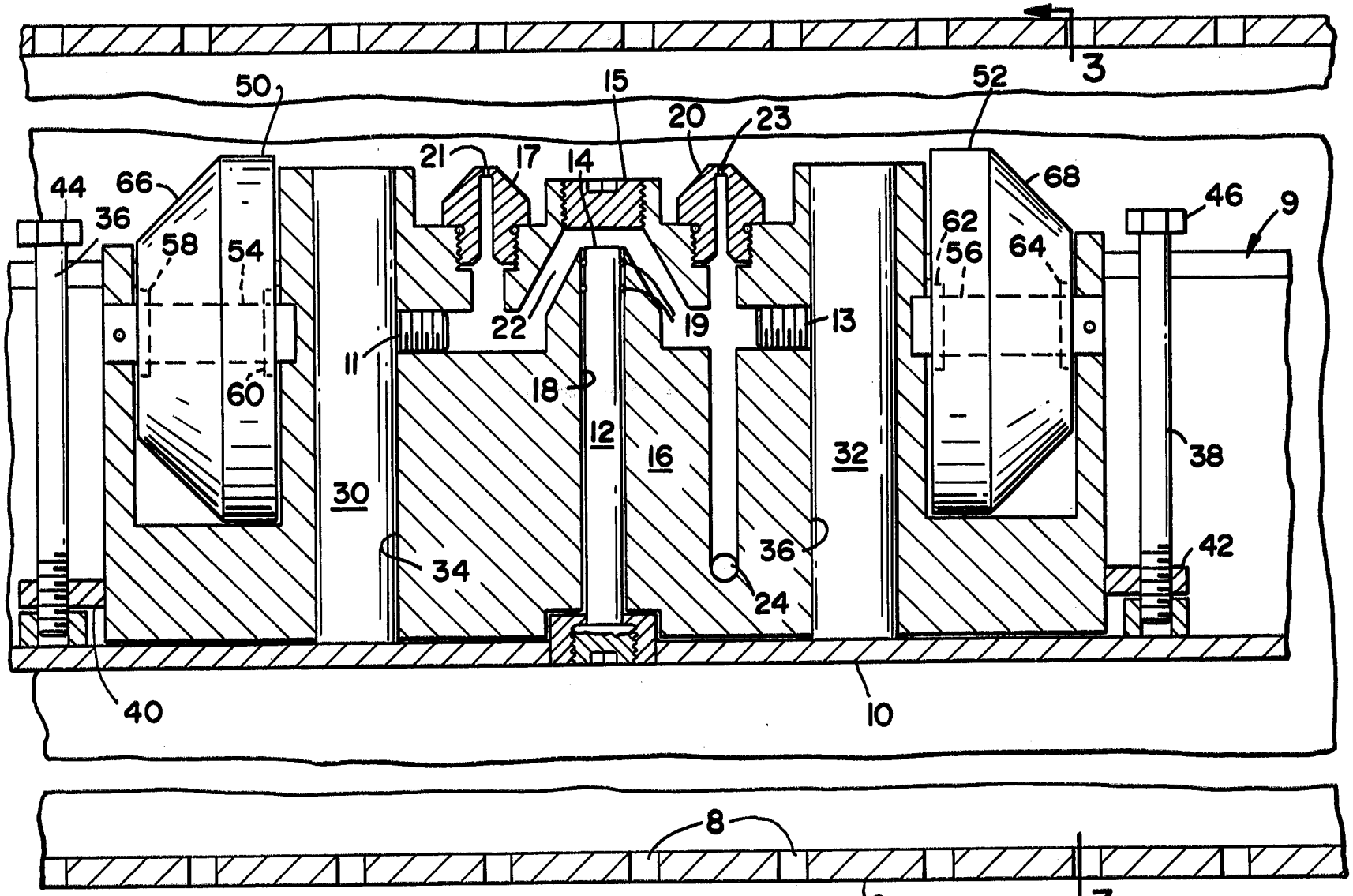
FIG. 1 is an elevation view, partially in section, and illustrates the preferred embodiment of apparatus assembled in accordance with the present invention.
Figure 2:
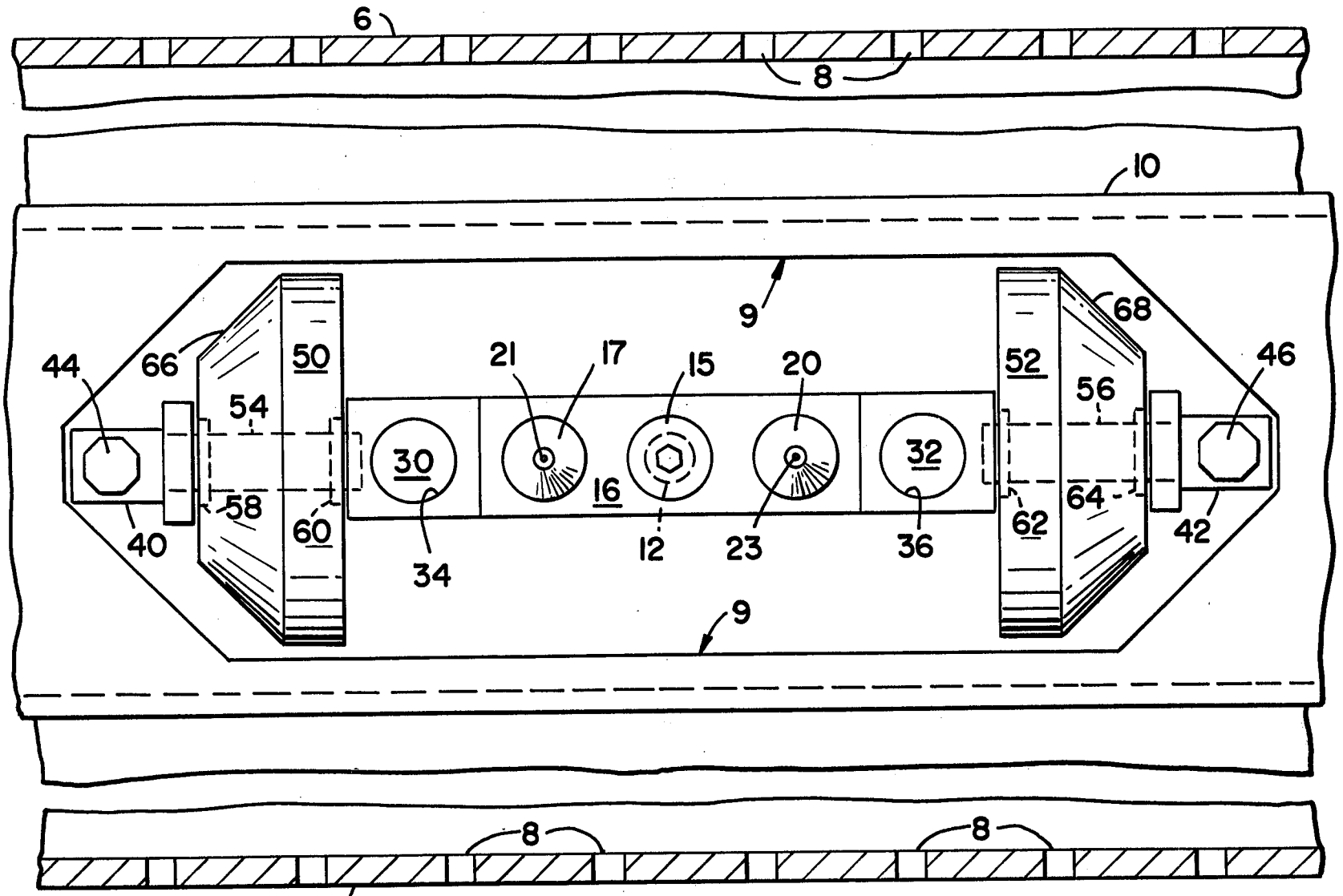
FIG. 2 is a top view of the apparatus illustrated in FIG. 1.

The preferred embodiment of the present invention will now be described in detail with reference to FIGS. 1–4. An elongated member (partially shown) 10 is formed from suitable elements such as a drill string, tubing sections, casing sections or other elements which can be inserted and run down a well to a location such as adjacent the openings in well liner 6 where cleaning is desired. The elongated member 10 is preferably tubular and is provided with a cut-out portion 9 in which a movable member 16 is recessed. The movable member can move out to engage the liner 6. A stationary shaft 12 is fixedly connected to the elongated member by mating threads or by welding. The shaft 12 has a free end extending perpendicular to the centerline of the elongated member 10. The base 14 of the free end of the shaft is flat to provide a base for pressurized liquid. The movable member 16 having a central opening 18 extending through a portion of its length is fitted over the shaft 12 in sliding relationship therewith. Suitable seals 19 provide a liquid-tight seal between the shaft 12 and the movable member 16. The movable member may be constructed of several welded-together sections or may be fabricated from a single piece of material.

One or more jet bodies 17, 20 are connected into the movable member. Each jet body 17, 20 is provided with a central jet-forming opening 21, 23 for forming a jet of liquid suitable for cleaning. A passageway 22 is formed in the movable member 16 and provides liquid communication between each of the jet-forming openings 21, 23 in the jet bodies 17, 20 and the base end 14 of the shaft 12 in the central opening 18. The passageway 22 is closed off to the exterior of the movable member 16 by suitable plugs 11, 13, 15. A liquid inlet port 24 communicates with the passageway 22 and provides liquid communication to the passageway 22 from a source of high-pressure liquid located outside the movable member. A tube or other suitable conduit may serve as the connecting means. When jetting liquid is forced into the passageway, it will be jetting through the jet-forming openings and also will cause the movable member to move out until its movement is stopped by the liner 6 being jetted.

A pair of interior guide posts 30, 32 are fixedly connected to the elongated member 10 such as by welding. The movable member 16 is provided with bores 34, 36, which are slightly larger in diameter than the diameter of the interior guide posts 30, 32. Thus the guide posts guide the reciprocal movement of the movable member 16 and assist in stabilizing it. A pair of exterior guide posts 36, 38 are also fixedly connected to the elongated member. A pair of sleeve members 40, 42 each fixedly connected to one side of the movable member 16 engage each of the exterior guide posts. A limit flange 44, 46 is connected to the end of each of the guide posts 36, 38 to limit the movement of the movable member 16.

A pair of spaced-apart wheels 50, 52 are rotatably connected to the movable member and have a common axis of rotation perpendicular to the shaft member 12 and parallel to the longitudinal centerline of the elongated member 10. Axles 54, 56 are provided with suitable bearings 58, 60, 62, 64 to rotatably mount the wheels 50, 52. The wheels are of sufficient diameter to extend beyond the extent of the movable member 16 and the end of the jet bodies 17, 20 so as to be engageable against the well liner 6 which is being cleaned to provide a standoff distance for the jets. The diameter of the wheels is selected to give the desired jet standoff distance for the jet openings from the liner 6. As noted in the above-cited patent, standoff must not be more than 10 jet diameters. The wheels also serve the very important function of permitting the apparatus to be rotated on the liner when jetting pressure is being applied. Thus, the wheels allow rotation of the jets to ensure hitting all the openings around the well liner. The outside end 66, 68 of each wheel is beveled to permit the apparatus to be moved through tight sections in the liner as it is raised or lowered in the well.

In summary, the present invention provides apparatus for jet-cleaning wells having different-diameter casing strings, which apparatus includes an elongated member for running into a well and a movable member having a jet body for forming a jet connected thereto, which movable member moves out against the casing string responsive to application of jetting liquid between the movable member and the elongated member.

Although only certain specific embodiments of the invention have been described in detail, the invention is not so limited and is meant to encompass all embodiments coming within the scope of the appended claims.

What is claimed is:

1. Apparatus for use in cleaning wells comprising an elongated member adapted to be run into a well to a location where cleaning is desired, a stationary member connected to said elongated member, a movable member slidably connected to said stationary member for movement perpendicular to centerline of said elongated member in response to liquid pressure applied between said movable member and said stationary member, a jet body having a central jet-forming opening for forming a jet of liquid connected to said movable member, passageway means in said movable member forming liquid communication to said jet-forming opening and to a location between said movable member and said stationary member, a liquid inlet port providing liquid communication into said passageway means from outside said movable member and said stationary member, and at least one wheel member rotatably mounted on said movable member, said wheel member having an axis of rotation parallel to the axis of elongation of said elongated member and perpendicular to said stationary member and having sufficient diameter to extend beyond said movable member and said jet body so as to be engageable against a well liner and to provide jet standoff therefrom.

2. Apparatus for use in cleaning slots in a well liner comprising an elongated member adapted to be run into a well to a location where cleaning is desired, a statutory shaft member connected to said elongated member and having a free end extending perpendicular thereto, a movable member having a central opening through a portion of its length fitting over the free end of said shaft in slidable liquid-tight relationship therewith, a jet body having a central jet-forming opening therethrough for forming a jet of liquid connected to said movable member, a passageway formed in the interior of said movable member to provide liquid communication between the jet-forming opening in said jet body and the free end of said shaft through said central opening, a liquid inlet port in said movable member providing liquid communication into said passageway from outside said movable member, and at least one wheel member rotatably mounted on said movable member, said wheel member having an axis of rotation parallel to the axis of elongation of said elongated member and perpendicular to said stationary shaft member and having sufficient diameter to extend beyond said movable member and said jet body so as to be engageable against a well liner and to provide for jet stand-off therefrom.

3. The apparatus of claim 2 further characterized in that said elongated member is a tubular element having a cut-out portion in which said stationary member is connected and into which said movable member may be recessed.

4. The apparatus of claim 3 further characterized by a source of pressurized liquid and a conduit connecting said source of pressureized liquid with said liquid inlet port.

5. Apparatus for use in cleaning slots in a well liner comprising an elongated member adapted to be run into a well to a location where cleaning is desired, a shaft member connected to said elongated member and having a free end extending perpendicular thereto, a movable member having a central opening through a portion of its length fitting over the free end of said shaft in slidable liquid-tight relationship therewith, a pair of jet bodies each having a central jet-forming opening therethrough for forming a jet of liquid connected in spaced-apart relationship to said movable member, a passageway formed in the interior of said movable member to provide liquid communication between the jet-forming openings in said jet bodies and in the free end of said shaft through said central opening, a liquid inlet port in said movable member providing liquid communication into said passageway from outside said movable member, a pair of spaced-apart wheel members rotatably mounted on said movable member, said wheel members having a common axis of rotation perpendicular to said shaft member and having sufficient diameter to extend beyond said movable member and said jet bodies so as to be engageable against a well liner to provide for jet standoff therefrom, at least a pair of spaced-apart guide posts connected to said elongated member and having an end extending at right angles therefrom, a sleeve member slidingly connected to each of said guide posts and fixedly connected to said movable member and a limit flange connected to the end of each of said guide posts for engaging said collars to limit movement of said movable member.

6. The apparatus of claim 5 further characterized in that said elongated member is a tubular element having a cut-out portion in which said stationary member is connected and into which said movable member may be recessed.

7. The apparatus of claim 6 further characterized by a source of pressurized liquid and a conduit connecting said source of pressurized liquid with said liquid inlet port.

* * * * *